US006463856B1

(12) United States Patent
Koch

(10) Patent No.: US 6,463,856 B1
(45) Date of Patent: Oct. 15, 2002

(54) ELECTRONICALLY AND MECHANICALLY-OPERATED IGNITION DELAY FOR CARTRIDGE-TYPE PYROTECHNIC DECOY FLARE AMMUNITION

(75) Inventor: Ernst-Christian Koch, Kaiserslautern (DE)

(73) Assignee: Pepete GmbH, Hanau (DE)

( * ) Notice: Subject to any disclaimer, the term of this patent is extended or adjusted under 35 U.S.C. 154(b) by 0 days.

(21) Appl. No.: 09/937,500

(22) PCT Filed: Jan. 24, 2000

(86) PCT No.: PCT/EP00/00497

§ 371 (c)(1),
(2), (4) Date: Sep. 27, 2001

(87) PCT Pub. No.: WO00/60302

PCT Pub. Date: Oct. 12, 2000

(30) Foreign Application Priority Data

Mar. 31, 1999 (DE) ..... 199 14 670

(51) Int. Cl.[7] ..... F42B 4/26; F42C 15/24; F42C 15/40

(52) U.S. Cl. ..... 102/336; 102/247; 102/248; 102/262

(58) Field of Search ..... 102/336, 247, 102/248, 262

(56) References Cited

U.S. PATENT DOCUMENTS 3,451,306 A 6/1969 Lagerstrom et al. ..... 89/1
3,712,224 A 1/1973 Hanzel ..... 102/37.6
4,729,316 A * 3/1988 Evrand et al. ..... 102/248 X
4,815,381 A * 3/1989 Bullard et al. ..... 102/262 X
4,927,172 A * 5/1990 Motozawa ..... 102/247 X
5,561,259 A 10/1996 Herbage et al. ..... 102/334
5,693,906 A * 12/1997 Van Sloun ..... 102/248 X
6,055,909 A * 5/2000 Sweeny ..... 102/336
6,129,022 A * 10/2000 Hickey et al. ..... 102/247 X

* cited by examiner

*Primary Examiner*—Peter A. Nelson
(74) *Attorney, Agent, or Firm*—Foley & Lardner

(57) ABSTRACT

The invention relates to an electronically and mechanically-operated ignition delay which is used in cartridge-type pyrotechnic decoy flare ammunition. Said ignition delay comprises a cylindrical sleeve (10), containing an ignition device (1) in the base, a propellant (2) for expelling the inflammable active material (8) and devices (9) for delaying the ignition of the active material. The electric ignition device of the propellant charge is galvanically connected to a capacitor element (3) which is fixed in the propulsion reflector (4). Said capacitor element is galvanically connected to a mechanical switch-on element (7) in the active material, whereby said mechanical switch-on element is, in turn, galvanically connected to an electric ignition unit in the active material. The switch-on process is thus triggered by the relative movement of the active material as it travels along the sleeve axis away from the propulsion reflector.

2 Claims, 1 Drawing Sheet

Figure 1:
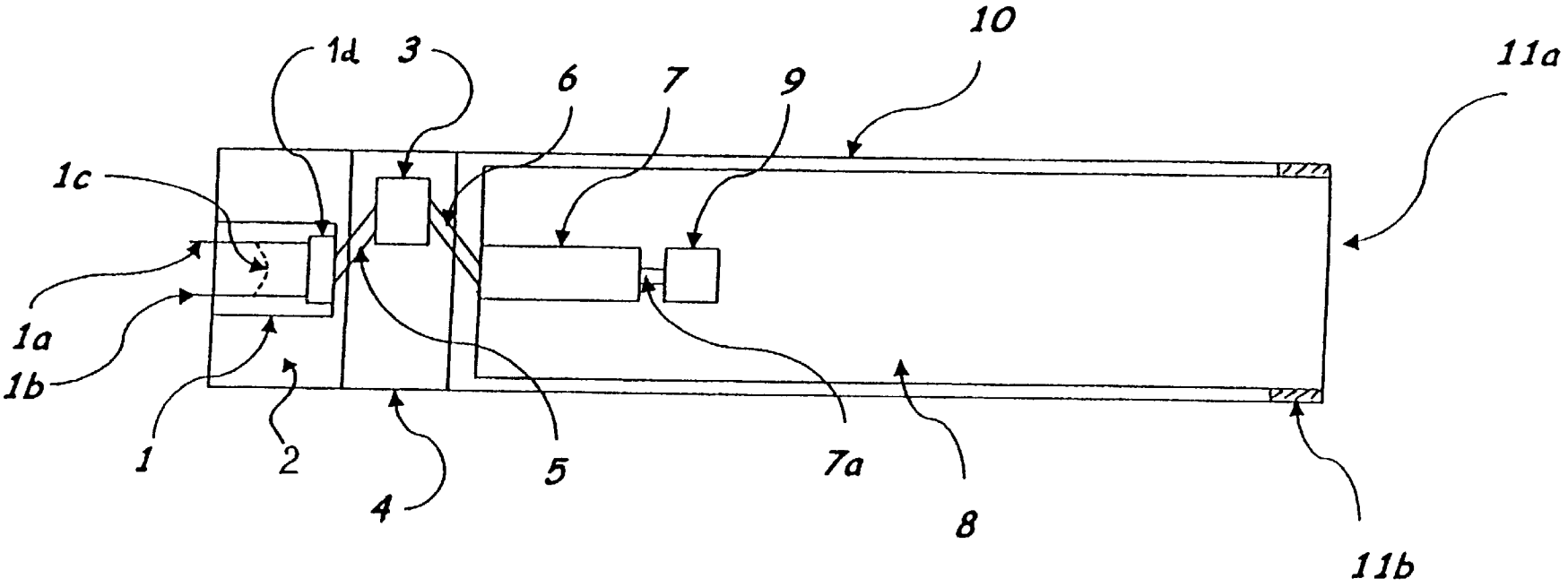

ELECTRONICALLY AND MECHANICALLY-OPERATED IGNITION DELAY FOR CARTRIDGE-TYPE PYROTECHNIC DECOY FLARE AMMUNITION

The invention concerns a device for ignition delay for electrically-operated ammunition, especially decoy flare ammunition with pyrotechnic, pyrophoric or hypergolic active masses.

For the defence from guided missiles with infrared homing heads, aircraft are served, inter alia, with pyrotechnic infrared emitters, so-called flares. These flare ammunitions generally consist of a cartridge case with electrical ignition device and pyrotechnic active mass. Cartridges for decoy flare ammunition are available in many calibers. Thus, there are cylindrical ammunitions with the calibers 26.5, 36,, 38, 40 and 55 mm. Furthermore, there are ammunitions with rectanguler cross-section with the calibers 25×25, 25×52 and 52×65 mm. As active masses, there are frequently used charges based on magnesium/Teflon/viton or based on red phosphorus, furthermore pyrophoric and hypergolic active masses are known. Characteristic for all flare active masses is the strong heat development and flame formation occurring in the case of the burning up.

For use-tactical reasons, the maximum heat development in the case of the use of flares must, after the discharge, be achieved as near as possible to the aircraft. This means that the active mass already a few decimeters after the discharge from the cartridge case must have achieved its greatest reaction speed in order to ensure the optimum protection effect.

In order to achieve this objective, it would now be logical to ignite the active mass similarly as in the case of pyrotechnic signal ammunition directly within the cartridge case with the help of the propellent. However, against this process speaks the danger of the damaging and destruction of the discharge device or even of the aircraft due to the most very vigorous burning off of the active mass already in the discharge device.

In order to prevent such a premature burning off of the active mass in the discharge device, one uses so-called tubular fuses. These devices ensure that the active mass is first ignited outside of the discharge device.

Examples for such tubular fuses are e.g. slider safeguarding, such as is described e.g.. in U.S. Pat. No. 5,561,259. The principle of this safeguarding is based on the fact that, by the burning off of the propellant, a pyrotechnic delaying element (VZ element) is initiated in a propulsion reflector. If the propulsion reflector reaches outside of the cartridge case, then, by means of spring power, the ignition canal between VZ element and active mass-sided igniter is freed and the ignition of the active mass takes place. If, for example, the propellant is too weak and the active mass and especially the propulsion reflector still remain in the cartridge case, then the ignition canal between the ignited VZ element still remains closed and no initiation of the active mass could occur.

Another form of the tubular fuse provides that, due to the firing acceleration, a mechanical safety device, a so-called g-safety device in a propulsion reflector element is no longer in force. If now this propulsion reflector reaches outside of the cartridge case then, similarly as above described, by means of spring power a stop is removed and a striking pin is released which initiates the active mass via a percussion cap.

The disadvantages of these safety devices consist in that, on the one hand, inert parts of high weight fall to the ground and thus exercises over inhabited grounds are inadmissible. On the other hand, in the case of joint flights, the danger exists that these parts can get into the driving systems of other machines and, in the extreme case, the affected driving system can break down.

A special disadvantage of the last-mentioned tubular fuses consists in the danger of an unintended initiation in the case of the production of such ammunition. Thus, only a small acceleration loading suffices in order to place the g-safety device out of action and to remove the safety of the striking pin for the initiation of the percussion cap where-by, after removal of the active material body from the cartridge case, it come to the firing of the active mass.

Another tubular fuse already long since known and in use functions via a frictional element. By means of a propellant, the active mass body is thereby pushed from the cartridge via the propulsion reflector. On the cartridge mouth, a subcaliber tapering ensures that the propulsion reflector is securely held. On the other hand, because of the acceleration, the active mass moves further and separates from the propulsion reflector. A frictional wire fixed on the propulsion reflector is, therefore, pulled by a frictional detonating cap integrated in the active mass and brings about the initiation of the active mass (decoy flare MJU-8A/B).

In the case of this technical solution, no inert parts are ejected since the propulsion reflector remains in the cartridge and the detonating cap burns off with active body. However, of considerable disadvantage is the high mechanical sensitivity of the friction element. Thus, in the past many accidents have occurred in the case of the transport, loading and discharging of these ammunitions.

The problems of established tubular fuses are thus:

1. Ejected inert parts of high weight which fall to the ground and can possibly get into the driving apparatus of other machines.
2. Danger of unintentional release in the dismounting of ammunition with acceleration safety device.
3. High accident risk in the case of ammunition with frictional wire safety device.

It is the task of the present invention to overcome these disadvantages.

The solution of the problem is given by the features of the main claim and is promoted by the features of the subsidiary claims.

According to the invention, there is provided a tubular fuse for electrically operable pyrotechnic ammunition which prevents the problems in the handling of friction elements and in the case of which no inert parts are ejected after the expulsion of the active mass body.

As given in FIG. 1, the ammunition according to the invention consists of a cartridge case 10 with inserted electrical igniter 1, propulsion reflector 4 and active mass 8.

The electrical igniter (squib) 1 with contact pins 1*a* and 1*b* and the bridging wire 1*c* is galvanically 5 connected with a capecitor element 3 via a suitable electronic circuit 1*d* which is present in the propulsion reflector 4.

The capacitor element 3 in the propulsion reflector 4 is also connected galvanically 6 with a mechanical switch-on element 7 in the active mass 8. This switch-on element 7 is in turn connected galvanically 7*a* with an electrical igniter 9 in the active mass 8.

In the case of firing, the electrical ignition impulse brings about the release of the propellent 2 via the bridging wire 1*c* in the squib and the charging of the capacitor element 3 in the propulsion reflector 4. Due to the gas pressure of the propellent 2, the propulsion reflector 4 with the loaded capacitor element 3 and the active mass lying in front is moved through the cartridge 10. The galvanic connection between propulsion reflector 4 and squib 1 can be selectively interrupted or remain. On the cartridge opening 11*a,* a subcaliber ring 11*b* brings it about that the propulsion reflector 4 is securely held. However, because of the acceleration, the active mass 8 moves further and separates from the propulsion reflector 4. The switch-on element 7 in the active mass 8 connected with the propulsion reflector 4 is actuated by the movement of the active mass 8 relative to the propulsion reflector 4 and the galvanic connection between capacitor element 3 and ignition pill 9 in the active mass 8 is produced and wherewith the active mass 8 is rendered operative.

The advantages of the arrangement according to the invention are especially no ejection of inert parts;

no-ignition possible in the cartridge;

no danger of unintentional initiation due to bump or friction;

no danger of unintentional initiation in the case of dismounting of the ammunition.

What is claimed is:

1. Electronic-mechanical ignition delay for cartridge-type pyrotechnic decoy ammunition containing a cylindrical cartridge (10) with an ignition device in the bottom, a propellent (2) for the ejection of the inflammable active mass (8) and devices for the delayed ignition of the active mass (8), characterised in that the electrical ignition unit (1) of the propellent (2) is galvanically connected with a capacitor element (3) fixed in the propulsion reflector (4) whiten in turn is galvanically connected with a mechanical switch-on element (7) in the active mass (8), whereby the mechanical switch-on element (7) is also galvanically connected with an electrical ignition unit (9) in the active mass (8), whereby the switch-on procedure is initiated by the relative movement of the active mass (8) along the cartridge axis away from the propulsion reflector (4).

2. Electronic-mechanical ignition delay according to claim 1, characterised in that the propulsion reflector, (4) is securely held by a subcaliber ring (11*b*) in the opening (11*a*) of the cartridge (10), whereas the subcaliber active mass can pass through and the mechanical switch-on element (7) is firmly connected with the propulsion reflector (4) so that, after ignition of the active mass (8) has taken place, it can be pulled out of this.

* * * * *